US006030685A

United States Patent [19]

Schweighardt et al.

[11] Patent Number: 6,030,685

[45] **Date of Patent: *Feb. 29, 2000**

[54] CARPET AND YARNS THEREFOR

[75] Inventors: John Michael Schweighardt, Midlothian, Va.; David Paul Paradis, Cartersville; Charles Jayroe Cole, Dalton, both of Ga.; Dale Alan Hangey, Midlothian, Va.

[73] Assignee: AlliedSignal Inc., Morristown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,632

[22] Filed: Aug. 4, 1997

Related U.S. Application Data

[63] Continuation of application No. 08/486,724, Jun. 7, 1995, abandoned.

[51] Int. Cl.[7] ..... B32B 3/02

[52] U.S. Cl. ..... 428/97; 428/92

[58] Field of Search ..... 428/97, 92

[56] References Cited

U.S. PATENT DOCUMENTS

| | | | |
|---|---|---|---|
| 2,769,300 | 11/1956 | Luttge | 57/140 |
| 4,458,053 | 7/1984 | Lofquist et al. | 525/183 |
| 4,882,222 | 11/1989 | Talley, Jr. et al. | 428/362 |
| 4,919,997 | 4/1990 | Twilley et al. | 428/227 |
| 4,961,243 | 10/1990 | Barber | 428/97 |
| 5,057,368 | 10/1991 | Largman et al. | 428/397 |
| 5,284,009 | 2/1994 | Tung et al. | 57/239 |
| 5,643,662 | 7/1997 | Yeo et al. | 442/361 |

FOREIGN PATENT DOCUMENTS

| | | |
|---|---|---|
| 0 255 697 | 7/1987 | European Pat. Off. . |
| 0 290 192 | 4/1988 | European Pat. Off. . |
| 0 324 773 | 11/1990 | European Pat. Off. . |
| 0 600 331 | 11/1992 | European Pat. Off. . |
| 2645004 | 3/1989 | France . |
| 52-059 745 | 5/1977 | Japan . |
| 03 241 058 | 10/1991 | Japan . |
| 04 100 949 | 4/1992 | Japan . |
| 05 009 860 | 1/1993 | Japan . |

OTHER PUBLICATIONS

Textile Research Institute, "Hydrophilic Nylon for Improved Apparel Comfort", by R.A. Lofquist, P.R. Saunders, T.Y. Tam, and I.C. Twilley, pp. 325–333.

*Primary Examiner*—Terrel Morris
*Assistant Examiner*—Arti R. Singh
*Attorney, Agent, or Firm*—Virginia S. Andrews; Melanie L. Brown; Roger H. Criss

[57] ABSTRACT

A carpet product comprises a backing material and a face yarn, wherein the face yarn comprises synthetic carpet fibers and synthetic fibers having high moisture transport properties. Preferred face yarns are composed of a combination yarn comprising the synthetic carpet fibers commingled with the synthetic fibers having moisture transport properties. The carpet products have a texture and feel approximating that of conventional synthetic fiber facings, yet effectively transport moisture so that the carpets feel drier upon exposure to moisture.

14 Claims, No Drawings

CARPET AND YARNS THEREFOR

This application is a continuation of application Ser. No. 08/486,724 filed Jun. 7, 1995, now abandoned.

BACKGROUND OF THE INVENTION

Conventional carpet products made of synthetic fibers include carpets intended for "wall-to-wall" installation, area rugs, bath rugs and scatter rugs. These products are typically made of synthetic carpet fibers, such as nylon 6, nylon 66, a polyolefin or a polyester, applied to a backing material. Through the years, a variety of carpet products have been developed that offer desired combinations of durability, texture and feel.

A drawback to using carpet products in areas where they may be exposed to high levels of moisture, such as in residential bathrooms, is that the fibers may become wet or soggy. Mold or mildew may form if the carpet products are slow to dry. Additionally, the feel of a wet carpet underfoot is undesirable.

Many conventional synthetic carpet fibers, such as fibers formed of nylon polymers, have little absorbency of liquid moisture and a tendency to resist water at their surface. Additionally, carpet fibers having a water-repellent finish have been proposed. However, since liquid moisture is retained at the fiber surface on such fibers, the carpet still feels wet underfoot. And when moisture is pressed into the carpet fibers such as by stepping or walking with wet feet, the carpet backing may become saturated with water.

Carpet products made of water absorbent fibers, such as cotton fibers, have been marketed for bathroom applications. Generally, these carpets do not have the bulk attributed to carpets employing synthetic fibers such as nylon polymer fibers, for example, the carpet tufts lay flat. And although the carpet fibers absorb water so as to prevent water from penetrating to the carpet backing, the carpet fibers are slow to dry and still feel wet underfoot.

SUMMARY OF THE INVENTION

The invention provides a carpet product comprising a backing material and a face yarn, wherein the face yarn comprises synthetic carpet fibers and second fibers which are synthetic fibers having effective moisture transport properties.

The invention also relates to preferred face yarns that are composed of a combination yarn comprising the synthetic carpet fibers commingled with the synthetic fibers having moisture transport properties.

The carpet products have a texture and feel approximating that of conventional synthetic fiber facings, yet effectively transport moisture so that the carpets feel drier upon exposure to moisture.

DETAILED DESCRIPTION OF PREFERRED EMBODIMENTS

The face yarn used in the carpet products of the invention comprises synthetic carpet fibers and synthetic fibers having moisture transport properties.

As used herein, the term "carpet fibers" denotes fibers conventionally used in carpet face yarns, including yarns used in carpets intended for "wall-to-wall" installation, area rugs, bath rugs and scatter rugs. The carpet fibers are characterized as providing bulk to the carpet facing. The carpet fibers include those formed of nylon polymers, such as nylon 6 and nylon 66, those formed of polyolefins such as polypropylene, and those formed of polyesters.

The second fibers have higher moisture transport properties than the carpet fibers. As used herein, the term "moisture transport properties" denotes the ability of the fibers to effectively transport moisture from a moisture source to which a portion of the fiber is exposed. Although commercial carpet fibers have limited ability to transport moisture, these second fibers used in the invention are exclusive of conventional carpet fibers and are distinguished by their increased ability to transport moisture, as discussed in more detail below.

Suitable second fibers include many synthetic fibers known to exhibit "wicking action". For example, there are commercial fibers developed and marketed for textile apparel applications due to their wicking action, since a desired property for synthetic textile apparel applications is the ability to wick perspiration.

A first preferred class of second fibers include those having the ability to transport moisture along the length of the fiber. As one example, there are fibers having special configurations that provide the fiber with the ability to transport liquid moisture from a moisture source along a length of the fiber by capillary action.

These known fibers include those having surface channels or grooves extending axially along the fiber, whereby liquid moisture may be transported through the channel or groove.

One example of a commercial fiber believed to have surface channels and marketed for textile products are hydrophobic fibers formed of polyester and sold under the trademark COOLMAX by E.I. DuPont (Wilmington, Del., USA).

Additionally, U.S. Pat. No. 5,057,368 (Largman et al.) discloses trilobal or tetralobal fibers formed from synthetic fibers, wherein the fiber cross-section is comprised of a central core having three or four essentially T-shaped lobes. The T-shaped lobes form channels and provide the fibers with good liquid wicking properties. EP 0,600,331-A (Dugan et al.) also discloses synthetic fibers wherein the fiber has T-shaped lobes such that the lobes form lengthwise open channels for wicking liquids. EP '331 also discloses that the surfaces of the channels may be rendered hydrophilic, such as by treatment with a hydrophilic spin finish.

Other fibers having suitable moisture transport properties include synthetic microfibers employed in the textile apparel industry. As used herein, the term "microfibers" denotes fibers composed of individual filaments having a denier per filament less than 2, more preferably less than 1, and having a total denier between about 70 to about 120, more preferably about 80 to about 100. The microfibers are commonly made of a nylon polymer. Due to the relatively large number of individual fine-denier filaments, the microfibers have a relatively large number of interstices between individual filaments, whereby the microfibers have the ability to transport moisture along a length of the fiber by capillary action.

According to preferred embodiments of the invention, the second fibers include hydrophilic fibers that not only have the ability to transport moisture along a length of the fiber, but also the ability to transport moisture away from the fiber surface.

More specifically, preferred fibers in this class include fibers formed of copolymers of nylon, especially nylon 6, and a hydrophilic moiety. These copolymers exhibit increased hydrophilicity in comparison with nylon polymers due to the inclusion of the hydrophilic moiety. As an example, the fibers may be formed of a block copolymer of nylon and poly(ethylene oxide)diamines (PEOD). These fibers are disclosed in U.S. Pat. No. 4,919,997 (Twilley et al.), and R. A. Lofquist et al., "Hydrophilic Nylon for Improved Apparel Comfort", Textile Research Journal, Vol. 55, No. 6, pp 325–333 (1985). As a further example, the fibers may be formed of a graft copolymer composed of nylon and a low molecular weight poly (dimethylacrylamide) grafted on the nylon chain. These fibers are disclosed in U.S. Pat. No. 4,458,053 (Lofquist et al.) and the aforementioned article by Lofquist et al.

Especially preferred are fibers formed of a block copolymer of nylon 6 and PEOD and available under the trademark HYDROFIL (AlliedSignal Inc., Morris Township, N.J., USA). These fibers have the ability to effectively transport moisture, thereby imparting a drier feel to carpets incorporating the fibers in the face yarn. Additionally, the ability of these fibers to absorb moisture is dependent on humidity conditions. Accordingly, at high humidity conditions, such as when exposed to a liquid moisture source, the fibers have higher absorption rates, thereby contributing to quick absorption or transport of liquid moisture. At lower humidity conditions, the fibers tend to desorb moisture, thereby permitting the fibers to dry.

As mentioned, the carpet fibers include those formed of nylon polymers, such as nylon 6 and nylon 66, those formed of polyolefins such as polypropylene, and those formed of polyesters. The carpet fibers may be initially provided as staple fiber or bulked continuous filament (BCF).

Although it is conceivable to add separately the carpet fibers and the fibers having moisture transport properties to a carpet backing, it is preferred that the carpet fibers and the second fibers are first combined into a combination yarn. This provides for a more uniform distribution of the two types of fibers. Additionally, this ensures that the resultant combination yarn can be more easily added to a carpet backing by conventional tufting or weaving methods. Methods for combining two types of fibers are known in the art, and various methods are described in EP-0,324,773 (Hackler), incorporated herein by reference. Representative methods are described below.

For combination yarns formed from staple carpet fiber, the combination yarns can be formed by blending staple carpet fibers and the second fibers by conventional blending methods, and the resultant blended fibers will generally then be carded, pinned, and spun into a singles yarn. This "combination" singles yarn can be added directly into carpet, or optionally, this yarn can be twisted and plied with another singles yarn to form a 2-ply or 3-ply construction. Generally, the resultant yarn is twist-set, and multiple ends of the desired yarn are then tufted or woven into a carpet backing.

For combination yarns processed from BCF yarns, BCF carpet filament fibers and the second fibers can again be combined into a combination yarn by conventional methods. As an example, the carpet fibers and the second fibers can be combined by direct cabling or a twisting process, so as to commingle the two types of fibers into a combination yarn. This combination singles yarn can be formed directly into carpet, or optionally, this yarn can be twisted and plied with another yarn to form a 2-ply or 3-ply construction. Generally, the resultant yarn is twist-set. Multiple ends of the desired yarn are then tufted or woven into a carpet backing.

According to preferred embodiments, BCF carpet fibers and second fibers are commingled by air entanglement according to known processes. More specifically, two types of fibers are taken up by a mingling nozzle, and a jet of air impinges upon the yarns traveling through the nozzle, thereby entangling (or commingling) the yarns.

The BCF carpet fibers will generally have a total denier of about 800 to about 3900, and a denier per filament of about 6 to about 28. The preferred second fibers will generally have a total denier of about 20 to about 400, more preferably of about 40 to about 200. The second fibers may have a denier per filament no greater than about 5 dpf. The carpet fibers will generally have a total denier of about 800 to about 3900, and a denier per filament of about 6 to about 28. The preferred second fibers will generally have a total denier of about 20 to about 400, more preferably of about 40 to about 200. The second fibers may have a denier per filament no greater than about 5 dpf.

The combination yarns of the invention are able to transport moisture away from a moisture source more effectively and more quickly than carpets wherein substantially all the face yarn is composed of conventional carpet fibers. This provides a drier feel to face yarns having been exposed to moisture. To illustrate, the combination yarn will have a wicking rate of at least about 1.0 cm/min (based on vertical wicking over a 5 minute interval by the methodology described in the Example below). In comparison, conventional nylon carpet fibers generally have a wicking rate no greater than about 0.5 cm/min. Conceivably, carpets could be manufactured wherein substantially all the face fibers were formed of various described second fibers. However, such carpets would generally lack the bulk and texture of conventional carpets made of synthetic carpet fibers.

Generally, the combination yarns of the invention will include at least about 50 weight percent of the synthetic carpet fibers to ensure that face fibers formed from the combination yarn will have sufficient bulk, and at least about 3 weight percent of the second fibers having moisture transport properties to ensure that face fibers formed therefrom have the desired ability to transport moisture. Accordingly, it is preferred that the combination yarns comprise about 50 to about 97 weight percent of the synthetic carpet fibers, and about 3 to about 50 weight percent of the second fibers. More preferably, the combination yarns comprise about 70 to about 95 weight percent of the synthetic carpet fibers, and about 5 to about 30 weight percent of the second fibers. Especially preferred are combination yarns comprising about 80 to about 92 weight percent of the synthetic carpet fibers, and about 8 to about 20 weight percent of the second fibers. One skilled in the art can readily ascertain optimum amounts of any specific combination of fibers for a desired application through routine testing.

The combination yarns can be incorporated into carpet products by conventional methods. As an example, the combination yarns are tufted or woven to a relatively pliable backing. Representative primary backings include woven fabrics of synthetic materials such as polypropylene, and woven fabrics of natural materials such as jute.

For carpet products such as carpet for wall-to-wall installation or area rugs, the non-wear side of a primary backing is generally coated with a bonding material such as latex for holding the fibers in place and preventing fibers from being pulled free of the primary backing. Generally, a secondary backing is applied to the back surface of the primary backing, wherein additional bonding material is applied to prevent delamination of the primary and secondary backings. The secondary backing strengthens the carpet and ensures that the bonding material does not come into contact with the floor.

For carpet products such as bath rugs or scatter rugs having a skid-resistant back surface, the yarn may be tufted or woven into a primary backing, followed by application of a thick elastomeric back coating such as latex according to conventional methods. The elastomeric back coating provides the rug with skid-resistance.

After the yarn is tufted or woven into the carpet backing, the combination yarn is dyed. As known in the art, when the primary backing is constructed of polypropylene, a relatively small amount of capcoat, consisting primarily of carpet staple yarn dyed to match the combination yarn, may be added to the polypropylene backing using a needlepunch operation prior to tufting or weaving of the face yarn. Since polypropylene does not take up dye as well as the combination yarn, the capcoat serves to conceal the polypropylene backing in case the carpet facing tufts are flattened. Alternately, the combination yarn can be dyed prior to tufting or weaving into the carpet backing, or solution spun-dyed yarns can be used.

The following examples illustrate various preferred embodiments of the invention.

EXAMPLES 1–4

In all the following Example yarns and the Control yarn, a bulked continuous filament (BCF) yarn made of nylon 6 polymer and composed of filaments having a trilobal cross-sectional shape was employed. This BCF yarn had a denier of 1202 and a denier per filament of 9.1.

In all the following Example yarns, a second yarn made of a block copolymer of nylon 6 (about 85%) and poly (ethylene oxide)diamine (about 15%) was employed. This yarn had a denier of 90 and a denier per filament of 2.65, and is available from AlliedSignal Inc. under the trademark HYDROFIL.

For the Control sample, a face yarn was made by twisting two BCF yarns (3.5×3.5 twist/inch), followed by twist-setting.

For the face yarn of Example 1, a combination yarn was made by air entangling one end of BCF yarn and four ends of the second yarn to form a singles yarn. Two ends of the singles yarn were taken up, twisted (3.5×3.5 twist/inch), and twist-set. The resultant combination yarn contained the second yarn at about 23 weight percent.

For the face yarn of Example 2, a combination yarn was made by air entangling one end of BCF yarn and two ends of the second yarn to form a singles yarn. Two ends of the singles yarn were taken up, twisted (3.5×3.5 twist/inch), and twist-set. The resultant combination yarn contained the second yarn at about 13 weight percent.

For the combination yarn of Example 3, a combination yarn was made by air entangling one end of BCF yarn and one end of the second yarn to form a singles yarn. Two ends of the singles yarn were taken up, twisted (3.5×3.5 twist/inch), and twist-set. The resultant combination yarn contained the second yarn at about 7.5 weight percent.

For the face yarn of Example 4, a combination yarn was made by air entangling one end of BCF yarn and one end of the second yarn, and the resultant yarn was twist-set. The combination yarn contained the second yarn at about 3.6 weight percent.

Carpet samples were prepared by tufting the Example yarns or Control yarn to a polypropylene backing containing capcoat staple fibers, and a latex backing was applied to the tufted backing. The carpet samples had a pile height of 0.7 inch, and a pile weight of 36 oz/yd$^2$.

Wicking Rate

Each of the yarn samples of Examples 1 to 4, and the Control yarn sample, was tested according to the following procedure. Yarn samples having a length of 12 inches were mounted from the side arm holding bracket of a buret stand and weighted with a 2-gram anchor. The bases of the yarn samples were immersed in a 250-ml beaker of an aqueous red dye solution, and the initial vertical position was recorded as height 0. Maintaining a constant vertical ruler position beside the vertical yarn sample, the vertical position of the red solution in the yarn sample was measured after 5 minutes. The procedure was repeated with multiple samples, and the recorded heights were averaged. The results summarized in Table 1 are derived from total vertical distance traveled over a 5-minute interval divided by 5 minutes.

TABLE 1

| Sample | Wicking Rate |
|---|---|
| Control (0% Second Fiber) | 0.48 cm/min |
| Example 4 (3.6% Second Fiber) | 1.00 cm/min |
| Example 3 (7.5% Second Fiber) | 2.20 cm/min |
| Example 2 (13% Second Fiber) | 2.00 cm/min |
| Example 1 (23% Second Fiber) | 1.80 cm/min |

The data demonstrate that the inventive combination yarns have significantly better wicking ability than yarns made solely of conventional synthetic carpet fibers.

Dryness Testing

Carpet samples obtained from the yarns of Examples 1 and 2, and carpet samples obtained from the Control yarn, were tested as follows. Twenty-ml of water was sprayed on the carpet surface, with the spraying confined to a 4-inch diameter area, and the wet carpet was left untouched for 5 minutes. Subsequently, a 4×4 inch square of muslim cloth was weighed, then folded to a 2×2 inch square, and affixed to each wet area of the carpet samples with a 5-pound weight. After five minutes on the carpet samples, the cotton cloth was removed and weighed. From the weight of the cloth prior to application to the wet carpet, and the weight of the cloth after application to the wet carpet, the amount of moisture transferred from the carpet sample to the cotton cloth contacting the sample was calculated. The results are summarized in Table 2.

TABLE 2

| Carpet Sample | Water Transferred |
|---|---|
| Control (0% Second Fiber) | 0.77 g |
| Example 2 (13% Second Fiber) | 0.49 g |
| Example 1 (23% Second Fiber) | 0.22 g |

The results summarized in Table 2 demonstrate the carpets formed of the combination yarn of the invention transferred less moisture to the contacting cloth when saturated with moisture. The test quantitatively demonstrates that the combination yarn would have a drier feel than the Control yarn.

Drying Tests

The carpet samples obtained from the yarns of Examples 1 and 2, and the Control yarn, were tested as follows. In a first set of tests, the weight of each sample was initially determined, then each sample was washed in a washing machine through an entire washing cycle. Upon removal from the washing machine, the weight of the sample was again measured. The sample was transferred to a laundry dryer and dried at four-minute intervals. At the end of each 4-minute interval, the sample was removed and weighed, then returned to the dryer for another 4-minute drying sample. The percent moisture retained at each interval was calculated, and the results are summarized in Table 3.

TABLE 3

| Carpet Sample (% Second Fiber) | % Moisture Retained | | | | | |
|---|---|---|---|---|---|---|
| | 0 Min | 4 Min | 8 Min | 12 Min | 16 Min | 20 Min |
| Control (0%) | 100 | 70.0 | 49.1 | 34.7 | 22.7 | 8.0 |
| Example 2 (13%) | 100 | 65.9 | 41.1 | 27.2 | 9.1 | 1.8 |
| Example 1 (26%) | 100 | 54.5 | 34.5 | 25.3 | 15.9 | 0.0 |

A second set of tests were performed as in the first set of tests, but the samples were allowed to dry under ambient conditions with weight measurements taken at one-hour intervals. The percent moisture retained at each interval was calculated, and the results are summarized in Table 4.

TABLE 4

| Carpet Sample (% Second Fiber) | % Moisture Retained | | | | | | | |
|---|---|---|---|---|---|---|---|---|
| | 0 Hrs | 1 Hr | 2 Hrs | 3 Hrs | 4 Hrs | 5 Hrs | 6 Hrs | 7 Hrs |
| Control (0%) | 100 | 75.5 | 56 | 38 | 25 | 15 | 6.8 | 5.1 |
| Example 2 (13%) | 100 | 73.6 | 52 | 35 | 22 | 14 | 7.2 | 2.4 |
| Example 1 (26%) | 100 | 76.9 | 59 | 41 | 27 | 17 | 10 | 4.3 |

The data in Table 3 demonstrate that carpets formed of the yarns of the invention dry more efficiently than carpets formed of conventional carpet yarns at the low humidity conditions found in a laundry dryer. (It is noted that the results summarized in Table 3 may be unique to the preferred embodiment of the invention where the second fibers have substantial hydrophilicity.) The data in Table 4 demonstrate the carpets formed of yarns of the invention generally dry comparatively to those formed of conventional carpet fibers at ambient conditions even though the yarns of the invention employed second fibers having higher hydrophilicity.

From the foregoing description, one skilled in the art can readily ascertain the essential characteristics of the invention, and without departing from the spirit and scope thereof, can readily make various changes and modifications of the invention.

What is claimed is:

1. A carpet product comprising a backing material and a face yarn, the face yarn comprising synthetic carpet fibers and second fibers, the second fibers having higher moisture transport properties than said synthetic carpet fibers and being formed of a block copolymer of nylon and a poly (ethylene oxide)diamine.

2. The carpet product of claim 1, wherein the synthetic carpet fibers are nylon.

3. The carpet product of claim 1, wherein the face yarn comprises about 50 to about 97 weight percent of the synthetic carpet fibers and about 3 to about 50 weight percent of the second fibers.

4. The carpet product of claim 1, wherein the face yarn comprises about 80 to about 92 weight percent of the synthetic carpet fibers and about 8 to about 20 weight percent of the second fibers.

5. A combination yarn comprising carpet fibers and second fibers, the second fibers having higher moisture transport properties than said carpet fibers and being formed of a block copolymer of nylon and a poly(ethylene oxide) diamine.

6. The combination yarn of claim 5, wherein the synthetic carpet fibers have a wicking rate less than 0.6 cm/min, and the combination yarn has a wicking rate of at least 1.0 cm/min.

7. The combination yarn of claim 5, wherein the synthetic carpet fibers are nylon.

8. The combination yarn of claim 5, comprising about 50 to about 97 weight percent of the synthetic carpet fibers and about 3 to about 50 weight percent of the second fibers.

9. The combination yarn of claim 5, comprising about 80 to about 92 weight percent of the synthetic carpet fibers and about 8 to about 20 weight percent of the second fibers.

10. The combination yarn of claim 5, wherein the synthetic carpet fibers have a total denier of about 800 to about 3900, and the second fibers have a total denier of about 20 to about 400.

11. The carpet product of claim 1, wherein said face yarn comprises said synthetic carpet fibers and second fibers, entangled to form a combination yarn.

12. The carpet product of claim 11, wherein the synthetic carpet fibers are nylon.

13. The combination yarn of claim 5, wherein said carpet fibers are entangled with said second fibers.

14. The combination yarn of claim 13, wherein the carpet fibers are nylon.

* * * * *